US011580940B1

(12) United States Patent
Ugactz

(10) Patent No.: US 11,580,940 B1
(45) Date of Patent: Feb. 14, 2023

(54) MULTI-POSITION GUITAR HOLDER AND METHODS OF USING SAME

(71) Applicant: Paul S. Ugactz, Green Cove Springs, FL (US)

(72) Inventor: Paul S. Ugactz, Green Cove Springs, FL (US)

( * ) Notice: Subject to any disclaimer, the term of this patent is extended or adjusted under 35 U.S.C. 154(b) by 47 days.

(21) Appl. No.: 17/397,959

(22) Filed: Aug. 9, 2021

(51) Int. Cl.
*G10D 3/00* (2020.01)
*G10G 5/00* (2006.01)

(52) U.S. Cl.
CPC ..... *G10G 5/00* (2013.01); *G10D 3/00* (2013.01)

(58) Field of Classification Search
CPC ..... G10G 5/00; G10D 3/00
See application file for complete search history.

(56) References Cited

U.S. PATENT DOCUMENTS

2016/0051046 A1* 2/2016 Sassman ..... A47B 95/008 211/85.6

* cited by examiner

*Primary Examiner* — Kimberly R Lockett
(74) *Attorney, Agent, or Firm* — Wei & Sleman LLP

(57) ABSTRACT

An instrument holder includes an elongated crossbar including a back surface and a front surface and extending between a first end and a second end, the first end having a perpendicular portion, and the second end including an angled portion and an offset portion, a slot bar coupleable to the first end of the elongated crossbar at the perpendicular portion, and a cradle coupleable to the second end of the elongated crossbar at the offset portion, the cradle being configured and arranged to couple to the back surface of the offset portion.

12 Claims, 3 Drawing Sheets

MULTI-POSITION GUITAR HOLDER AND METHODS OF USING SAME

FIELD OF THE DISCLOSURE

The present disclosure is directed to a guitar holder. More specifically, the present disclosure is directed to a guitar holder capable of being mounted at various angles.

BACKGROUND OF THE DISCLOSURE

Guitars are often retained in holders for display purposes. However, conventional holders are typically bulky and cumbersome. Additionally, conventional holders are limited in how the instrument is oriented, and may damage the instrument. Thus, it would be beneficial to provide continued improvements to these conventional devices.

SUMMARY OF THE DISCLOSURE

In some embodiments, an instrument holder includes an elongated crossbar including a back surface and a front surface and extending between a first end and a second end, the first end having a perpendicular portion, and the second end including an angled portion and an offset portion, a slot bar coupleable to the first end of the elongated crossbar at the perpendicular portion, and a cradle coupleable to the second end of the elongated crossbar at the offset portion, the cradle being configured and arranged to couple to the back surface of the offset portion.

BRIEF DESCRIPTION OF THE DRAWINGS

Various embodiments of the presently disclosed devices and methods are described herein with reference to the drawings, wherein.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to guitar holders, conventional devices suffer from some shortcomings as described above.

There therefore is a need for further improvements to the devices, systems, and methods of manufacturing and using guitar holders. Among other advantages, the present disclosure may address one or more of these needs.

Figure 1:
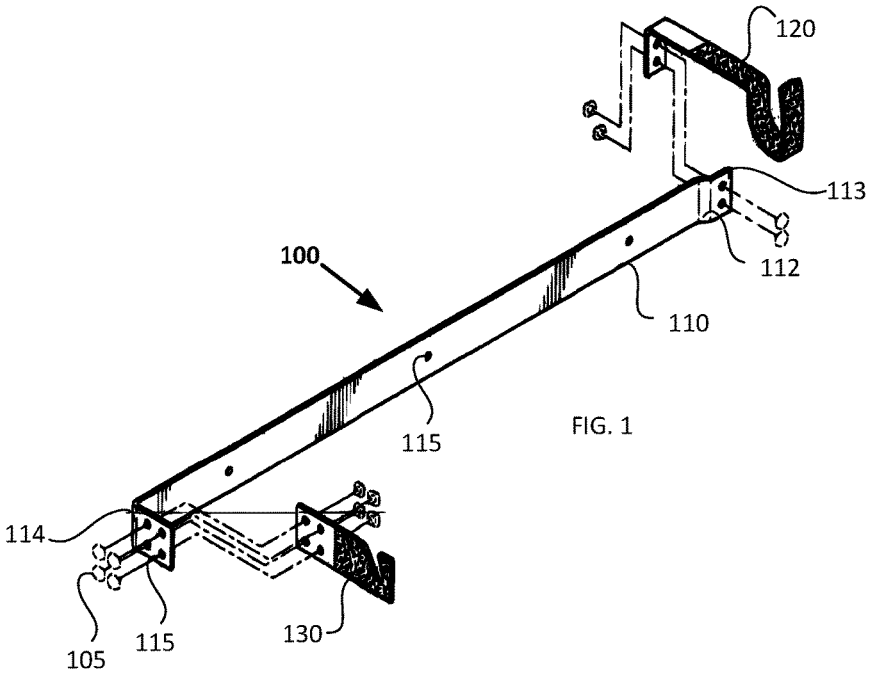
FIG. 1 is a schematic perspective exploded view of a guitar holder according to the present disclosure.

As shown in FIG. 1, guitar holder 100 may generally include a crossbar 110, a cradle 120 and a slot bar 130. As shown, crossbar 110 may extend from a first end to a second end with cradle 120 being attached to a second end and slot bar 130 being attached at a first end, opposite the second end. In at least some examples, the three components are unitarily formed. Alternatively, the three components (e.g., the crossbar, cradle and slot bar) may be separately formed and configured and arranged to be removeably coupleable together. By doing so, the holder may be reversed for alternate positioning as will be described below in greater detail. Any or all of the components may be formed of a metal (e.g., steel, iron, aluminum, etc.), a plastic or polymer, or a natural material (e.g., wood).

Crossbar 110 extends between the cradle 120 and slot bar 130 and connects the two parts at opposite ends. In at least some examples, crossbar 110 is between 20 and 35 inches in length. More specifically, crossbar 110 may be approximately or equal to 27 inches in length, may have a depth of 1.5 inches and a thickness of ⅛ inch. In some examples, crossbar 110 includes a telescoping member so that its length is variable. Crossbar 110 may include one or more slots or screw holes 115 formed therein. In at least some examples, crossbar 110 includes three screw holes 115 equally spaced from one another for mounting the crossbar to a surface. In at least some examples, an elongated cushioning material (e.g., silicone, fabric, cloth, etc.) may be disposed or applied to the front surface of crossbar 110 so that an instrument does not contact a hard edge or surface.

At one end, crossbar 110 may include a perpendicular portion 114 for mating with the slot bar, the perpendicular portion 114 being approximately 2 inches in length. This perpendicular portion 114 may include one or more screw holes (e.g., four screw holes are shown, alignable with screw holes of the slot bar.

Adjacent the cradle 120, crossbar 110 may include an angled portion 112 that provides an offset portion 113 for coupling to the cradle. Offset portion 113 may be approximately 1.5 inches in length and may include one or more screw holes (e.g., two screw holes 115 as shown) for coupling with the cradle, the angled portion providing a ¼ inch offset so that a portion of the cradle is disposed behind the offset portion 113 while the crossbar sits flush with a surface (e.g., ceiling, wall, etc.).

Figure 3:
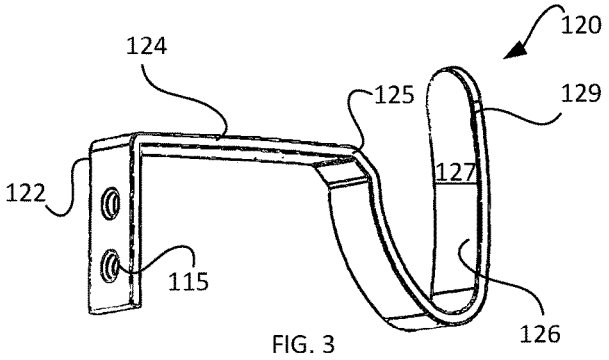
FIGS. 3-4 are detailed perspective and side views of a cradle of a guitar holder.
Figure 4:
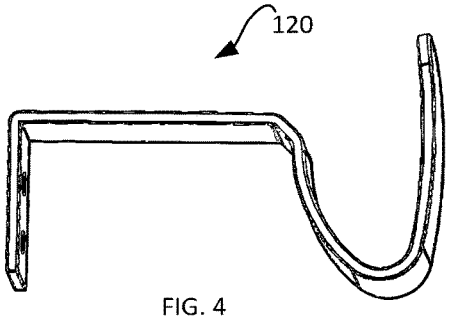

Cradle 120 may be attached to offset portion 113. Examples of cradle 120 are also shown in FIGS. 3-4. Cradle 120 is configured and arranged to receive and retain an instrument portion, such as a guitar neck. In one example, cradle 120 may include multiple bends and the cradle is ¾ in width×⅛th in thickness and 7-8 inches in length (prior to bending). The bends in the cradle 120 define a coupling portion 122, a lateral extension 124 that terminates in an eased portion 125 having a bend of approximately 45 degrees, which transitions into neck rest 126.

Neck rest 126 may be configured and arranged to "grasp" the neck of the instrument due to its exact neck thickness measurements. Eased portion 125 may allow the guitar neck to safely slide into the neck rest without occluding or scratching it. A rubber material 129, such as "Plasti-Dip" may be applied to all or parts of interior surfaces 127 of the neck to reduce or eliminate slippage. In some examples, rubber material 129 includes a liquid rubber that hardens over 24 hours. Holes 115 on the coupling portion 122 may align with holes in the crossbar's offset portion 113. In this example, the cradle may be mounted to the crossbar in two positions, a left-handed position and a right-handed position to accommodate different instruments and orientations. Screws, washers and/or fasteners 105 may be used to secure the cradle to the crossbar. In at least some examples, a cushion may be disposed between offset portion of the crossbar and the coupling portion of the cradle to eliminate direct metal-to-metal contact.

Figure 2:
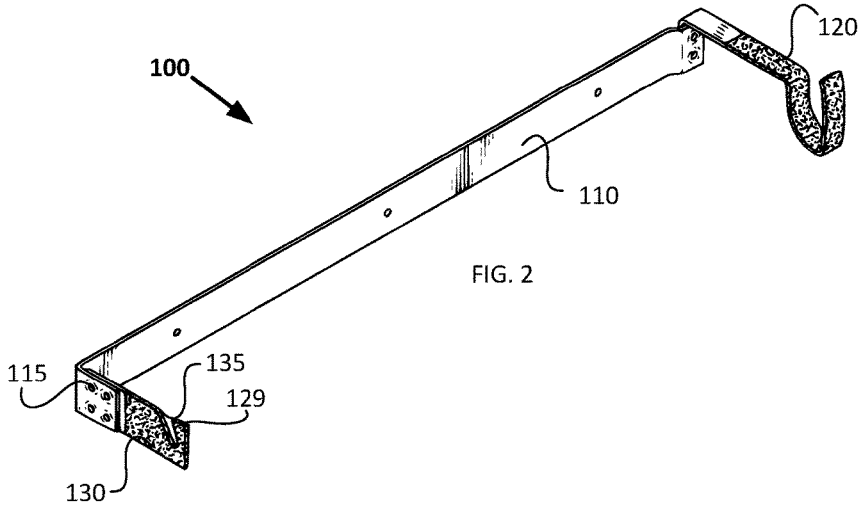
FIG. 2 is a schematic perspective assembled view of a guitar holder according to the present disclosure.

Turning back to FIG. 2, slot bar 130 may be configured and arranged to retain a strap button of an instrument (e.g., a guitar strap button commonly located at the bottom of the lower bout of a guitar body). Slot bar 130 may be approximately 4 inches in length, 1.5 inches in height and ⅛ inch in thickness and may include a plurality of holes 115. In at least some examples, the thickness of the slot bar is equal to or less than ⅛ of an inch. In at least some examples, slot bar 130 may be mounted to crossbar 110 in two positions (axially mirrored positions for right-handed and left-handed mounting). A receiving notch 135 may be cut into the slot bar, the receiving notch having gradually decreasing widths for retaining the guitar strap button. A rubber material 129 may also be applied to this portion of the slot bar to reduce slippage. In some examples, the receiving notch 135 may comprise a shape loosely resembling that of a curved V or U, however, other shapes are possible.

Figure 5:
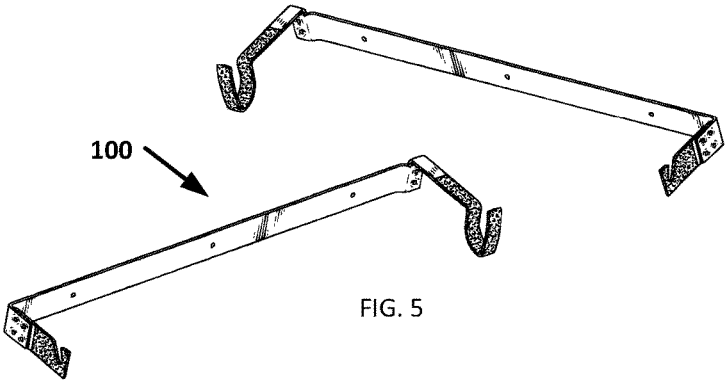
FIG. 5 shows the guitar holder in two positions for left and right-handed positioning.
Figure 6:
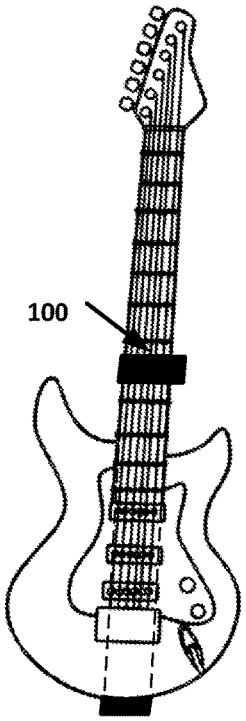
FIGS. 6-8 illustrate the holder in use with guitars in various positions.
Figure 7:
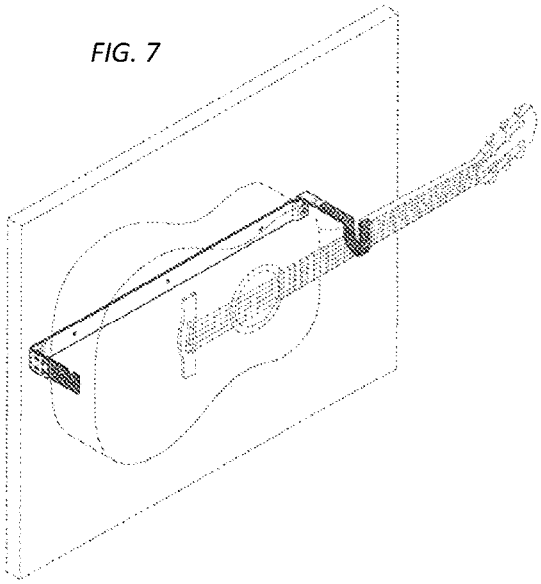
Figure 8:
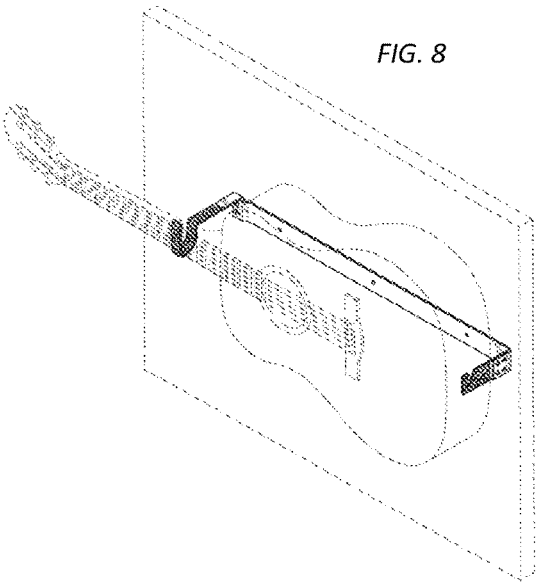

In use, guitar holder 100 may be mounted at any angle to a surface (e.g., wall, ceiling, vaulted ceilings, doors, garage doors, tour buses, marine vessels, etc.). The guitar is held within the holder 100 at two positions, the cradle and the slot bar, and the crossbar maintains a separation between these two components that accommodates most guitars, without damaging the instruments. Left-handed and right-handed mounting are possible (see, FIG. 5). Specifically, the crossbar may be oriented in the desired position, and the cradle and slot bars may be coupled as necessary. If an opposite position is required (i.e., left instead of right-positioning or vice versa), the crossbar may be rotated 180 degrees, and the cradle and slot bar may be coupled in mirrored positions (FIGS. 6-8).

Guitar holder 100 has been described herein with reference to a traditional guitar, but it will be understood that the holder may accommodate electric guitars, acoustic guitars, mandolins, ukuleles, banjos, violins, as well as other stringed and non-stringed instruments.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

I claim:

1. An instrument holder comprising:

an elongated crossbar including a back surface and a front surface and extending between a first end and a second end, the first end having a perpendicular portion, and the second end including an angled portion and an offset portion;

a slot bar coupleable to the first end of the elongated crossbar at the perpendicular portion; and a cradle coupleable to the second end of the elongated crossbar at the offset portion, the cradle being configured and arranged to couple to the back surface of the offset portion wherein the cradle includes a coupling portion for mating with the offset portion of the elongated crossbar, and a lateral extension orthogonal to the coupling portion.

2. The instrument holder of claim 1, wherein the slot bar includes a receiving notch.

3. The instrument holder of claim 2, wherein the receiving notch is V-shaped.

4. The instrument holder of claim 2, wherein the receiving notch is U-shaped.

5. The instrument holder of claim wherein the cradle further includes an eased portion having a bend.

6. The instrument holder of claim 5, wherein the bend extends at an angle of between 30 and 60 degrees with respect to the lateral extension.

7. The instrument holder of claim 6, wherein the bend extends at an angle of 45 degrees with respect to the lateral extension.

8. The instrument holder of claim 5, wherein the cradle further includes a substantially U-shaped neck rest.

9. A method of holding a musical instrument, comprising:

providing an elongated crossbar including a back surface and a front surface and extending between a first end and a second end, the first end having a perpendicular portion, and the second end including an angled portion and an offset portion;

providing a slot bar coupleable to the first end of the elongated crossbar at the perpendicular portion; and providing a cradle coupleable to the second end of the elongated crossbar at the offset portion, the cradle being configured and arranged to couple to the back surface of the offset portion, the cradle having a coupling portion for mating with the offset portion of the elongated crossbar, a lateral extension orthogonal to the coupling portion, an eased portion having a bend, and a substantially U-shaped neck rest.

10. The method of claim 9, further comprising choosing one of a right-handed or left-handed orientation of the crossbar.

11. The method of claim 9, further comprising coupling the slot bar to the first end of the elongated crossbar.

12. The method of claim 9, further comprising coupling the cradle to the second end of the elongated crossbar.

* * * * *